US008950964B1

(12) United States Patent
Jefferson

(10) Patent No.: US 8,950,964 B1
(45) Date of Patent: Feb. 10, 2015

(54) MOISTURE REMOVING AND DEODORANT APPLICATION SYSTEM

(71) Applicant: Tia Jefferson, Baltimore, MD (US)

(72) Inventor: Tia Jefferson, Baltimore, MD (US)

( * ) Notice: Subject to any disclaimer, the term of this patent is extended or adjusted under 35 U.S.C. 154(b) by 114 days.

(21) Appl. No.: 13/865,904

(22) Filed: Apr. 18, 2013

Related U.S. Application Data

(60) Provisional application No. 61/670,484, filed on Jul. 11, 2012.

(51) Int. Cl.
*A45D 40/06* (2006.01)
*A45D 40/18* (2006.01)

(52) U.S. Cl.
CPC ..... *A45D 40/06* (2013.01); *A45D 40/18* (2013.01)
USPC ..... 401/37; 401/31; 401/52; 401/68; 401/195

(58) Field of Classification Search
CPC ..... A45D 40/18
USPC ..... 401/29–33, 37, 52, 68, 195
See application file for complete search history.

(56) References Cited

U.S. PATENT DOCUMENTS 5,403,588 A 4/1995 Santa Ana, Jr.
2009/0175815 A1 7/2009 Batchelor et al.

*Primary Examiner* — David Walczak
*Assistant Examiner* — Joshua Wiljanen
(74) *Attorney, Agent, or Firm* — RG Patent Consulting, LLC; Rachel Gilboy

(57) ABSTRACT

A specially designed addition to stick deodorant packaging that incorporates a handy absorbent pad or brush that removes moisture from the skin prior to application. Design intent is to provide consumers with a novel tool that ensures optimal hygiene may be realized.

18 Claims, 5 Drawing Sheets

MOISTURE REMOVING AND DEODORANT APPLICATION SYSTEM

CROSS-REFERENCE TO RELATED APPLICATION

The present application is related to and claims priority from prior provisional application Ser. No. 61/670,484, filed Jul. 11, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of deodorant applicator devices and more specifically relates to a moisture removing and deodorant application system.

2. Description of the Related Art

Humans and animals perspire as a natural bodily process. Perspiration is defined by the Miller-Keane Medical Dictionary as "the excretion of moisture through the pores of the skin." A bodily function common to everyone, the body's perspiration output may exceed several quarts per day in high temperatures with high humidity, during strenuous exertion, or in times of emotional stress. In fact, even on a cool day with exertion or emotional stress, the body loses well over a pint of perspiration. This kind of sweating is known medically as "insensible" perspiration because it is virtually unnoticeable; as the sweat reaches the surface of the skin, it evaporates immediately. When sweating becomes noticeable, it is known as "sensible" perspiration. The chief function of sweat glands and perspiration is to maintain the body temperature at a constant level, thus cooling the skin as perspiration evaporates.

Even though perspiring is a natural bodily function, sweat can exude a very unpleasant body odor, especially from the underarm area. Permeating the air and the clothing, this odor not only makes others uncomfortable, but it may be also very embarrassing to the person perspiring. In addition to the body or underarm odor present on the garments, the perspiration leaves indelible stains and sometimes odor even after they've been cleaned. In order to prevent underarm perspiration from occurring, consumers typically apply antiperspirant deodorants, either in spray, roll-on, or stick form, to the underarm area after bathing. While deodorants can be very effective, the antiperspirant should be applied to a completely dry area of the skin. Unfortunately, this is not always possible. For example there are times when a user is in a hurry and neglects to completely dry the underarms after a shower. Additionally, those who are prone to excessive perspiration can start sweating immediately after carefully bathing, especially in high humidity environments. As a result, deodorant is applied to moist skin, which cannot properly absorb the antiperspirant for its intended purpose. This is undesirable and requires a practical and efficient solution.

Various attempts have been made to solve the above-mentioned problems such as those found in U.S. Pub. No. 2009/0175815 to Stephen Norman Batchelor et al; and U.S. Pat. No. 5,403,588 to Cesareo T Santa Ana, Jr. This art is representative of deodorant devices. None of the above inventions and patents, taken either singly or in combination, is seen to describe the invention as claimed.

Ideally, a moisture removing and deodorant application system should provide a device with which to dry the underarm area prior to applying a deodorant and, yet would operate reliably and be manufactured at a modest expense. Thus, a need exists for a reliable moisture removing and deodorant application system to avoid the above-mentioned problems.

BRIEF SUMMARY OF THE INVENTION

In view of the foregoing disadvantages inherent in the known deodorant devices art, the present invention provides a novel moisture removing and deodorant application system to provide a novel deodorant with an absorbent cleaning pad for removing moisture from the underarm area.

A moisture removing and deodorant application system is disclosed herein, in a preferred embodiment, comprising a moisture removing and deodorant application assembly. The moisture removing and deodorant application assembly comprises in combination a housing assembly, a deodorant stick used for controlling the odor of perspiration when applied, and a scraper. The housing assembly comprises a shell having an interior-volume and a cap for substantially enclosing the deodorant stick during non-use periods.

The interior-volume of the shell is able to contain the scraper, the deodorant stick, a spring and an internal plunger mechanism (which is able to raise the deodorant stick for use). The shell comprises a turnable-dial having groves which are useful for a user to grip the turnable-dial thereby raising and lowering the deodorant stick by raising and lowering the internal plunger mechanism which operates without interfering with the use of the spring within the shell. The spring is for use in raising the scraper in most embodiments.

A user is able to remove moisture from an underarm area using the scraper to achieve a clean and dry surface for applying ingredients from the deodorant stick thereto. The scraper may comprise a contoured surface having no sharp edges comprising an absorbent pad having a wicking volume useful for absorbing underarm moisture.

The scraper is able to be raised to an in-use condition via a push button located on a front surface of the shell as the push button releases the spring located within the shell. After removing moisture from the underarm area the user is able to lower the scraper into the shell of the housing assembly via the push button, thereby exposing the deodorant stick allowing the user to apply the deodorant stick to the underarm area to achieve maximum hygienic protection and effect on the dry surface. Upon completing application of the deodorant stick to the underarm area, the user is able to place the cap on the shell to preserve the deodorant stick for future use. A method of use is also disclosed herein.

The present invention holds significant improvements and serves as a moisture removing and deodorant application system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, moisture removing and deodorant application system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a deodorant applicator device and more particularly to a moisture removing and deodorant application system as used to improve the capacity of a deodorant to adhere to an underarm surface by removing moisture prior to applying the deodorant.

Generally speaking, adults and adolescents require a deodorant to use on their underarms on a repeated basis to help combat the odor resulting from perspiration emitting from their underarms. In order for the deodorant to have its optimum hygienic affect, the underarm area must be dry; placing a deodorant on an underarm area having moisture inhibits the ability of the ingredients of the deodorant to adhere and perform effectively.

The present invention removes moisture from the underarm area (prior to deodorant application) to provide a dry surface for the deodorant. While helping to eliminate the body order commonly caused by underarm sweating, the moisture removing and deodorant application system will also protect clothing from being stained by perspiration. As a result, consumers may avoid expensive dry cleaning bills or having to discard costly garments that have been ruined by sweat stains. Consumers will appreciate the benefits of the moisture removing and deodorant application system as both a hygienic method for handling embarrassing perspiration odor and the costs involved in prematurely replacing garments stained by sweat.

Figure 1:
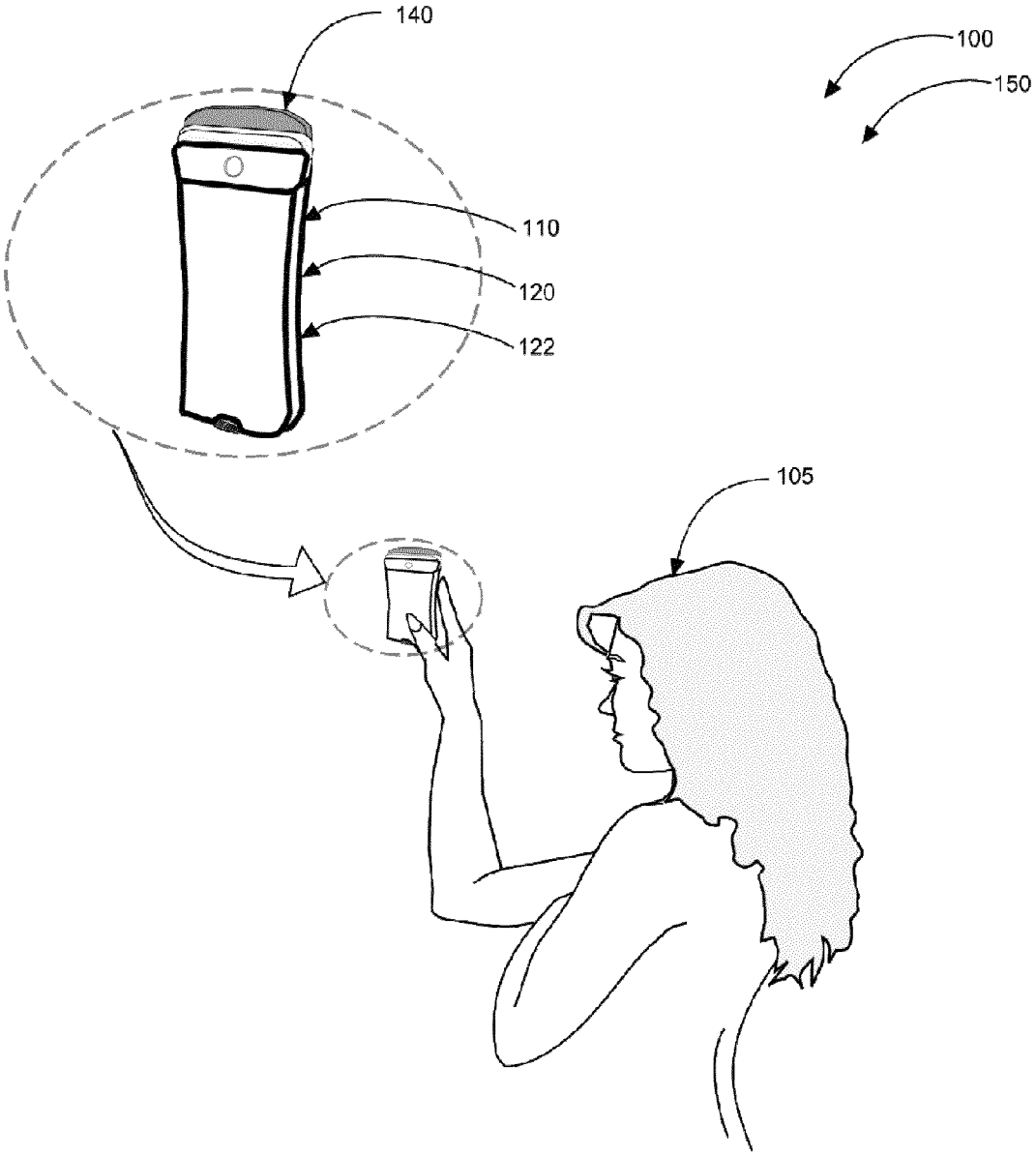
FIG. 1 shows a perspective view illustrating a moisture removing and deodorant application system in an in-use condition as a user is preparing to use the scraper according to an embodiment of the present invention.

Referring now to the drawings by numerals of reference there is shown in FIG. 1, moisture removing and deodorant application system 100 in an in-use condition 150 as user 105 is preparing to use scraper 140 according to an embodiment of the present invention.

Moisture removing and deodorant application system 100 preferably comprises moisture removing and deodorant application assembly 110. Moisture removing and deodorant application assembly 110 comprises in combination housing assembly 120, deodorant stick 145 used for controlling the odor of perspiration when applied, and scraper 140. Housing assembly 120 comprises shell 122 having interior-volume 124 and cap 126 for substantially enclosing deodorant stick 145 during non-use periods.

Figure 2:
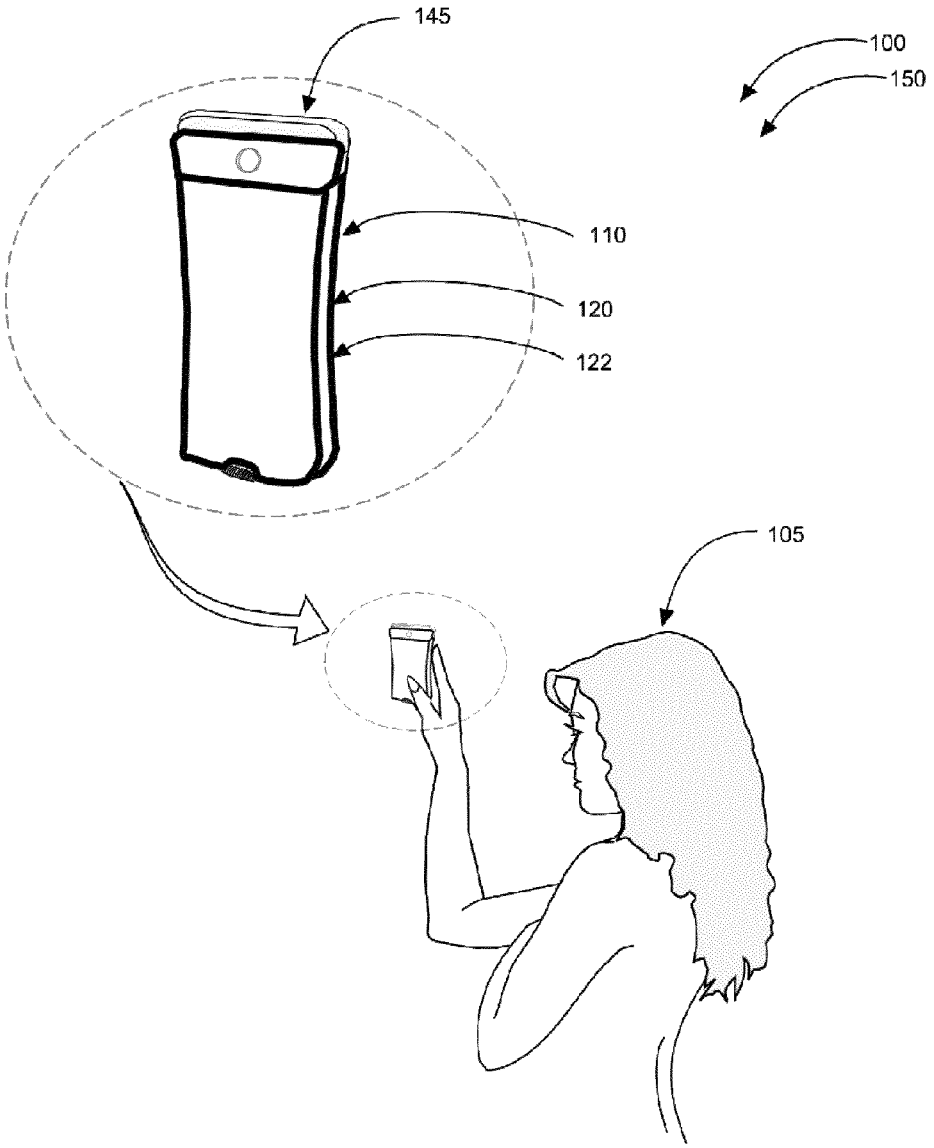
FIG. 2 is a perspective view illustrating the moisture removing and deodorant application system in an in-use condition as a user is preparing to use the deodorant stick according to an embodiment of the present invention of FIG. 1.

Referring now to FIG. 2, showing moisture removing and deodorant application system 100 in an in-use condition 150 as user 105 is preparing to use deodorant stick 145 according to an embodiment of the present invention of FIG. 1.

Interior-volume 124 of shell 122 is able to contain scraper 140, deodorant stick 145, spring 128 and internal plunger mechanism 130 which is able to raise deodorant stick 145 for use. Shell 122 further comprises turnable-dial 132 having groves 133 which are useful for user 105 to grip and rotate turnable-dial 132 thereby raising and lowering deodorant stick 145 by raising and lowering internal plunger mechanism 130 which operates without interfering with the use of spring 128 (if used) within shell 122. Various means for raising and lowering various components may be used and still remain within the scope of this disclosure. For example the means for raising the deodorant stick may pass through an aperture in a plate that raises scraper 140. Push button 135 for example may use frictioning means that may release upon activation.

Figure 3:
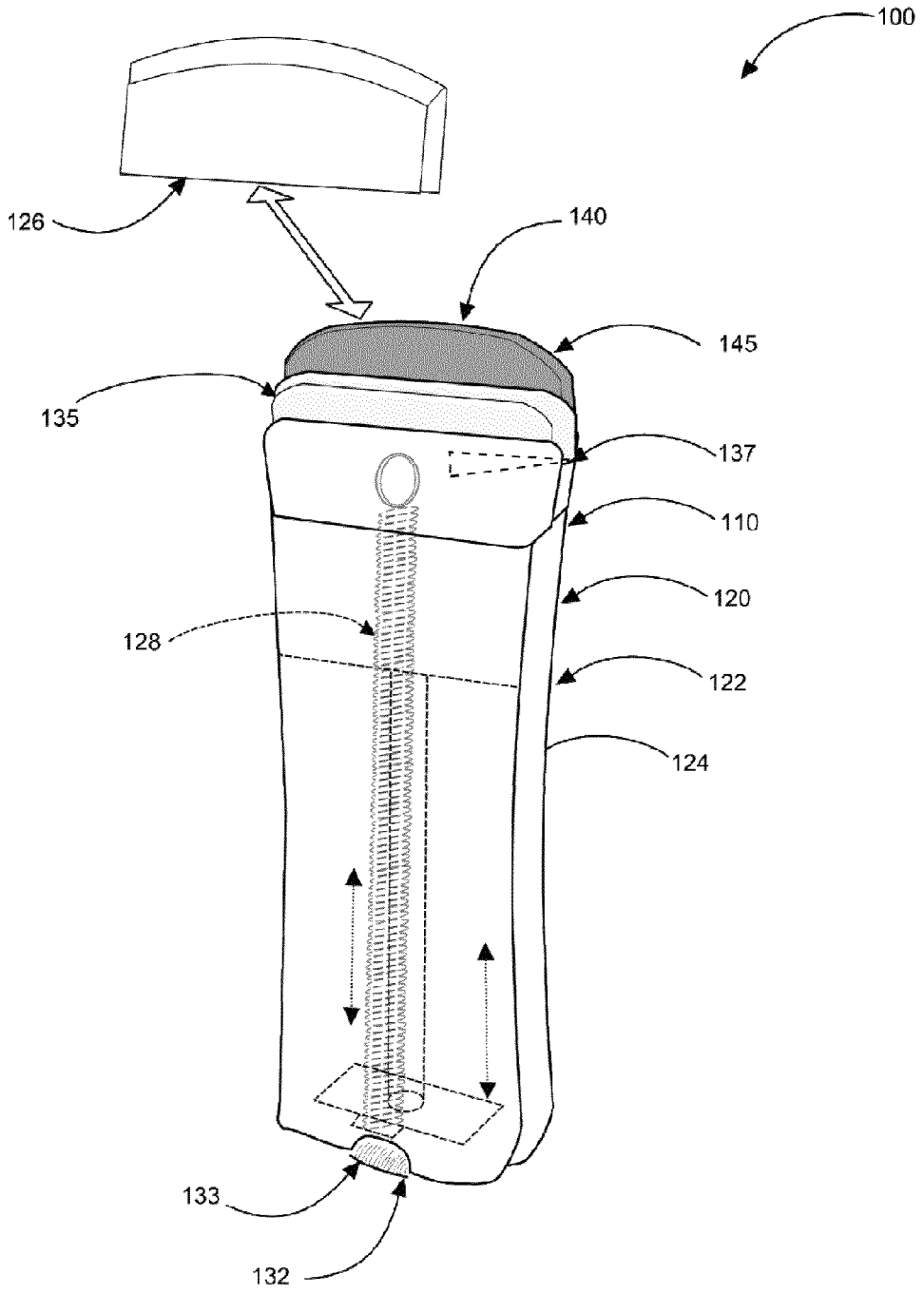
FIG. 3 is a perspective view illustrating the moisture removing and deodorant application system with the scraper extended for use according to an embodiment of the present invention of FIG. 1.

Referring now to FIG. 3, showing moisture removing and deodorant application system 100 with scraper 140 extended for use according to an embodiment of the present invention of FIG. 1

User 105 is able to remove moisture from an underarm area using scraper 140 to achieve a clean and dry surface for applying ingredients from deodorant stick 145 thereto. Scraper 140 comprises a contoured surface having no sharp edges comprising an absorbent pad having a wicking volume useful for absorbing underarm moisture. This particular feature helps prevent the user from chaffing or otherwise becoming injured since it is dull and prevents cutting, rather provides smooth scraping means. In an alternate embodiment scraper 140 comprises a foam brush with a pliable surface having bristles (not shown) and a non-wicking volume useful for removing underarm moisture.

Figure 4:
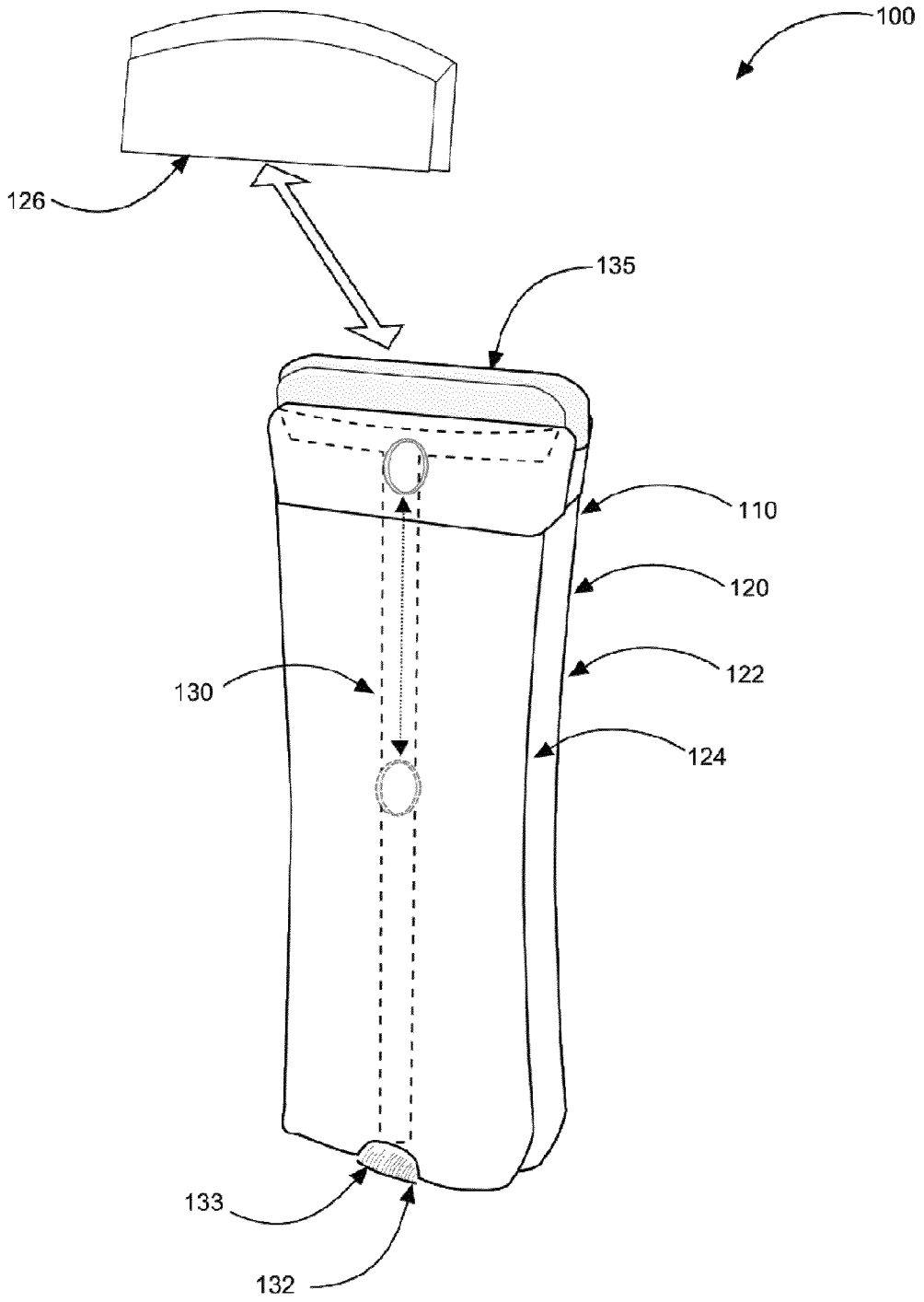
FIG. 4 is a perspective view illustrating the moisture removing and deodorant application system with the deodorant stick ready for use according to an embodiment of the present invention of FIG. 1.

Referring now to FIG. 4, showing moisture removing and deodorant application system 100 with deodorant stick 145 ready for use according to an embodiment of the present invention of FIG. 1.

Scraper 140 is able to be raised to in-use condition 150 via push button 135 (or other suitable means) located on a front surface of shell 122 as push button 135 releases spring 128 located within shell 122, as indicated by direction arrows. In an alternate embodiment scraper 140 is able to be lowered manually via finger pressure of user 105 into shell 122 when not in-use by compressing spring 128 located within shell 122, as shown in FIG. 3. In another alternative embodiment scraper 140 is able to be manually raised to an in-use condition and lowered to a non-use position via lever 137 on a back side of shell 122. Relative scraper 140 movement using manual means is also indicated by direction arrows that may move along a channel/guide or the like. Various configurations for springs, levering means may be used as known by those skilled in the art.

After removing moisture from the underarm area, user 105 is able to lower scraper 140 into shell 122 of housing assembly 120 via push button 135, thereby exposing deodorant stick 145 allowing user 105 to apply deodorant stick 145 to the underarm area to achieve maximum hygienic protection and effect on the dry surface. Upon completing application of deodorant stick 145 to the underarm area, user 105 is able to place cap 126 on the top opening of shell 122 to preserve deodorant stick 145 for future use.

Figure 5:
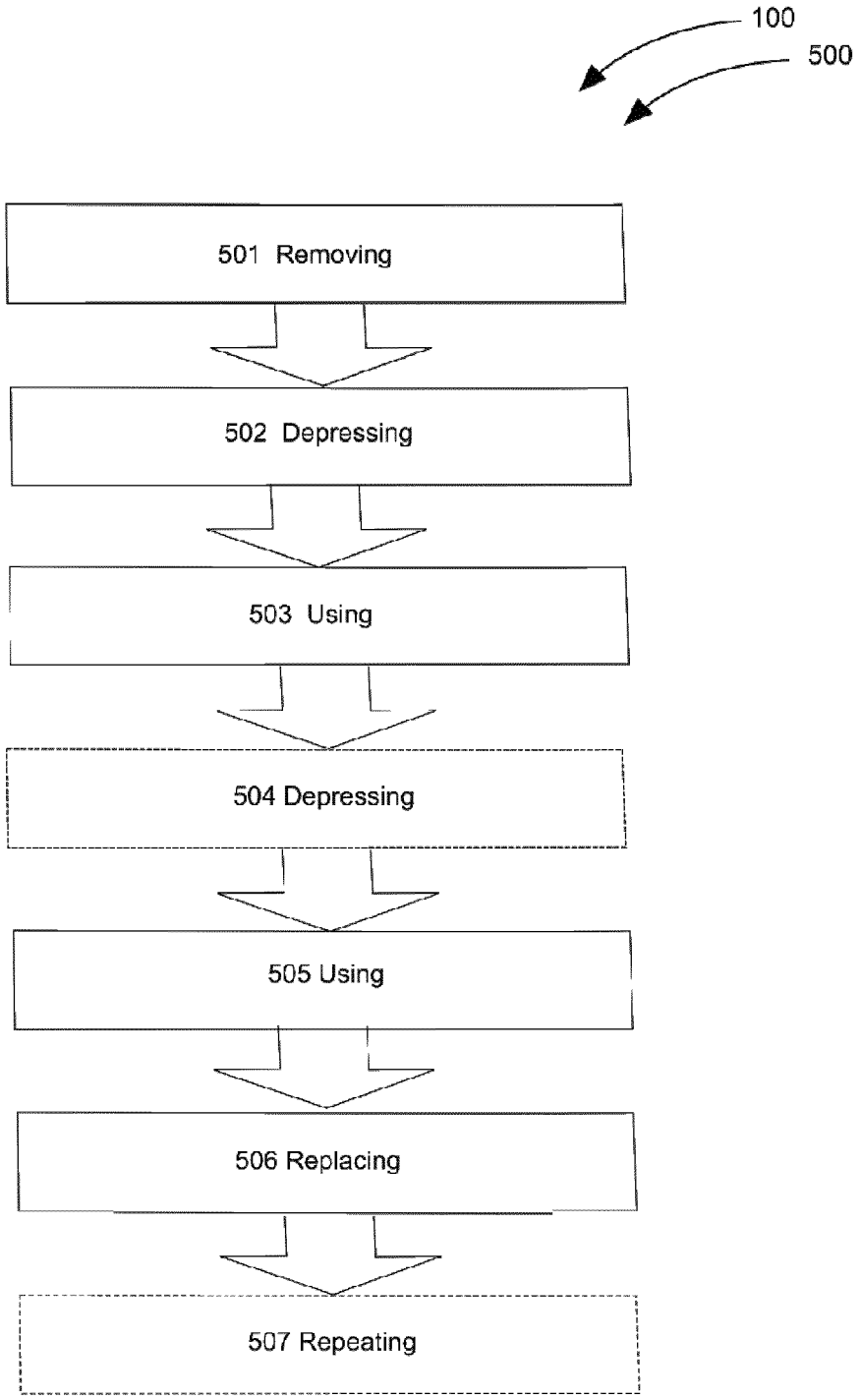
FIG. 5 is a flowchart illustrating a method of use for the moisture removing and deodorant application system according to an embodiment of the present invention of FIGS. 1-4.

Referring now to FIG. 5, a flowchart illustrating a method of use 500 for moisture removing and deodorant application system 100 according to an embodiment of the present invention of FIGS. 1-4.

A method of use 500 for moisture removing and deodorant application system 100 may comprise the steps of: step one 501 removing cap 126 from top opening of shell 122 of housing assembly 120; step two 502 depressing push button 135 to raise scraper 140 to an in-use position; step three 503 using scraper 140 on an underarm area to remove moisture; step four 504 depressing push button 135 to lower scraper 140 into interior-volume 124 of shell 122; step five 505 using deodorant stick 145 to apply ingredients of deodorant stick 145 to underarm area; and step six 506 replacing cap 126 on top opening of shell 122 to enclose deodorant stick 145 and scraper 140 within shell; and step seven 507 repeating steps as desired.

It should be noted that step 507 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A moisture removing and deodorant application system comprising:

a moisture removing and deodorant application assembly comprising;

a housing assembly comprising;

a shell having an interior-volume; and a cap;

a deodorant stick; and a scraper;

wherein said moisture removing and deodorant application system comprises said moisture removing and deodorant application assembly;

wherein said moisture removing and deodorant application assembly comprises in combination said housing assembly, said deodorant stick and said scraper;

wherein said housing assembly comprises said shell having an interior-volume and said cap for enclosing said deodorant stick during non-use;

wherein said deodorant stick is used for controlling odor of perspiration;

wherein a user is able to remove moisture from an underarm area using said scraper to achieve a clean and dry surface for applying said deodorant stick thereto;

wherein said user is able to lower said scraper into said shell of said housing assembly after use, thereby exposing said deodorant stick allowing said user to apply said deodorant stick to said underarm area to achieve maximum hygienic protection and effect on said dry surface; and wherein upon completion of application of said deodorant stick to said underarm area said user is able to place said cap on said shell to preserve said deodorant stick for future use.

2. The moisture removing and deodorant application system of claim 1 wherein said scraper comprises a contoured surface having no sharp edges.

3. The moisture removing and deodorant application system of claim 2 wherein said scraper comprises an absorbent pad useful for absorbing underarm moisture.

4. The moisture removing and deodorant application system of claim 3 wherein said scraper is able to be manually raised to an in-use condition via a lever on a back side of said shell.

5. The moisture removing and deodorant application system of claim 4 wherein said scraper is able to be manually lowered when not in-use into said shell via said lever on said back side of said shell.

6. The moisture removing and deodorant application system of claim 3 wherein said scraper comprises a wicking volume.

7. The moisture removing and deodorant application system of claim 2 wherein said scraper comprises a foam brush having a pliable surface useful for removing underarm moisture.

8. The moisture removing and deodorant application system of claim 7 wherein said scraper is able to be raised to an in-use condition via a push button located on a front surface of said shell, said push button releasing a spring located within said shell.

9. The moisture removing and deodorant application system of claim 8 wherein said scraper is able to be lowered manually via finger pressure into said shell when not in-use by compressing said spring located within said shell.

10. The moisture removing and deodorant application system of claim 9 wherein said shell comprises an internal plunger mechanism raising said deodorant stick for use.

11. The moisture removing and deodorant application system of claim 10 wherein said shell comprises said internal plunger mechanism lowering said deodorant stick when not in use.

12. The moisture removing and deodorant application system of claim 11 wherein said shell comprises a turnable-dial for raising and lowering said internal plunger mechanism.

13. The moisture removing and deodorant application system of claim 12 wherein said turnable-dial comprises groves useful for said user to grip said turnable-dial thereby raising and lowering said deodorant stick via said internal plunger mechanism without interfering with use of said spring within said shell.

14. The moisture removing and deodorant application system of claim 7 wherein said scraper comprises a non-wicking volume.

15. The moisture removing and deodorant application system of claim 14 wherein said scraper further comprises bristles.

16. The moisture removing and deodorant application system of claim 1 wherein said interior-volume of said shell is able to contain said scraper, said deodorant stick, said spring and said internal plunger mechanism.

17. A moisture removing and deodorant application system comprising:

a moisture removing and deodorant application assembly comprising;

a housing assembly comprising;

a shell having an interior-volume; and a cap;

a deodorant stick; and a scraper;

wherein said moisture removing and deodorant application system comprises said moisture removing and deodorant application assembly;

wherein said moisture removing and deodorant application assembly comprises in combination said housing assembly, said deodorant stick and said scraper;

wherein said housing assembly comprises said shell having an interior-volume and said cap for substantially enclosing said deodorant stick during non-use;

wherein said interior-volume of said shell is able to contain said scraper, said deodorant stick, said spring and an internal plunger mechanism;

wherein said shell comprises said internal plunger mechanism able to raise said deodorant stick for use;

wherein said shell comprises a turnable-dial for raising and lowering said internal plunger mechanism;

wherein said turnable-dial comprises groves useful for said user to grip said turnable-dial thereby raising and lowering said deodorant stick via said internal plunger mechanism without interfering with use of said spring within said shell;

wherein said deodorant stick is used for controlling odor of perspiration when applied;

wherein a user is able to remove moisture from an underarm area using said scraper to achieve a clean and dry surface for applying said deodorant stick thereto;

wherein said scraper comprises a contoured surface having no sharp edges;

wherein said scraper comprises an absorbent pad useful for absorbing underarm moisture;

wherein said scraper comprises a wicking volume;

wherein said scraper is able to be raised to an in-use condition via a push button located on a front surface of said shell, said push button releasing a spring located within said shell;

wherein said user is able to lower said scraper into said shell of said housing assembly after use, thereby exposing said deodorant stick allowing said user to apply said deodorant stick to said underarm area to achieve maximum hygienic protection and effect on said dry surface; and wherein upon completion of application of said deodorant stick to said underarm area said user is able to place said cap on said shell to preserve said deodorant stick for future use.

18. A method of using a deodorant cleaning system comprising the steps of:

removing cap from top opening of shell of housing assembly;

depressing push button to raise scraper to an in-use position;

using said scraper on underarm area to remove moisture;

depressing said push button to lower said scraper into interior-volume of said shell;

using deodorant stick to apply ingredients of said deodorant stick to said underarm area;

replacing said cap on said top opening of said shell to enclose said deodorant stick and said scraper within said shell; and repeating steps as desired.

* * * * *